US009296088B2

(12) United States Patent
Borucki et al.

(10) Patent No.: US 9,296,088 B2
(45) Date of Patent: Mar. 29, 2016

(54) METHOD AND DEVICE FOR THE INJECTION OF CMP SLURRY

(75) Inventors: Leonard John Borucki, Mesa, AZ (US); Yasa Adi Sampurno, Tucson, AZ (US); Ara Philipossian, Tucson, AZ (US)

(73) Assignee: Araca Inc., Tucson, AZ (US)

( * ) Notice: Subject to any disclaimer, the term of this patent is extended or adjusted under 35 U.S.C. 154(b) by 325 days.

(21) Appl. No.: 13/825,111

(22) PCT Filed: Dec. 16, 2010

(86) PCT No.: PCT/US2010/060801

§ 371 (c)(1),
(2), (4) Date: Sep. 26, 2013

(87) PCT Pub. No.: WO2012/082126

PCT Pub. Date: Jun. 21, 2012

(65) Prior Publication Data

US 2014/0011432 A1 Jan. 9, 2014

(51) Int. Cl.

| | |
|---|---|
| ***B24B 57/04*** | (2006.01) |
| ***B24B 57/02*** | (2006.01) |
| ***B24B 37/10*** | (2012.01) |
| ***B24B 37/04*** | (2012.01) |

(52) U.S. Cl.

CPC ..... *B24B 57/02* (2013.01); *B24B 37/04* (2013.01); *B24B 37/10* (2013.01)

(58) Field of Classification Search

CPC ..... B24B 57/04

USPC ..... 451/41, 60, 285–290, 446

See application file for complete search history.

(56) References Cited

U.S. PATENT DOCUMENTS

| | | | |
|---|---|---|---|
| 5,709,593 | A | 1/1998 | Guthrie et al. |
| 5,997,392 | A | 12/1999 | Chamberlin et al. |

(Continued)

FOREIGN PATENT DOCUMENTS

| | | |
|---|---|---|
| JP | 11-114811 | 4/1999 |
| JP | 2002-217146 | 8/2002 |

(Continued)

OTHER PUBLICATIONS

International Search Report for PCT/US2010/060801 completed Sep. 16, 2011.

(Continued)

*Primary Examiner* — Robert Rose

(74) *Attorney, Agent, or Firm* — Schmeiser, Olsen & Watts LLP

(57) ABSTRACT

In a certain embodiment, the invention comprises an apparatus for injecting slurry between the wafer and the pad in chemical mechanical polishing of semiconductor wafers comprising an injector the leading edge of which possess bays, depressions or notches that capture spent slurry and hold it long enough for it to transfer heat from the polishing reaction to the pad or through the injector to the new slurry before the said spent slurry is thrown from the polishing pad. The effect is to considerably improve the removal rate, reduce slurry consumption and reduce operating time.

18 Claims, 6 Drawing Sheets

(56) References Cited

U.S. PATENT DOCUMENTS

| | | | | |
|---|---|---|---|---|
| 6,284,092 | B1 | 9/2001 | Manfredi | |
| 6,336,850 | B1 | 1/2002 | Wada et al. | |
| 6,347,979 | B1 * | 2/2002 | Drill | 451/41 |
| 6,679,765 | B2 * | 1/2004 | Tung et al. | 451/60 |
| 7,008,302 | B2 | 3/2006 | Wu et al. | |
| 7,021,999 | B2 * | 4/2006 | Jiang et al. | 451/60 |
| 2003/0068959 | A1 | 4/2003 | Kajiwara | |
| 2010/0216373 | A1 * | 8/2010 | Borucki et al. | 451/6 |

FOREIGN PATENT DOCUMENTS

| | | |
|---|---|---|
| KR | 10-2000-0000583 | 1/2000 |
| WO | 2004073055 | 8/2004 |

OTHER PUBLICATIONS

PCT International Search Report, App No. PCT/US2010/060801, mailing date Sep. 16, 2011, International filed Dec. 16, 2010.

* cited by examiner

METHOD AND DEVICE FOR THE INJECTION OF CMP SLURRY

BACKGROUND OF INVENTION

Chemical mechanical planarization (CMP) slurry, together with polishing pads and diamond conditioner disks form the key components of the equipment used to carry out CMP processes in recent years. These polishing pads and diamond conditioner disks have been produced and marketed by several vendors to standards of reliable quality and effectiveness. The function of the polishing pad is to polish the wafer surface in conjunction with the slurry. As they accomplish this function, the polishing pads themselves become smooth and lose effectiveness in their capacity to polish the wafer surface. The function of the diamond conditioner discs, the surface facing the polishing pad of which is covered with small embedded diamonds or other hard substance, is to cut into and roughen the polishing pad surface during polishing so that it is continually being roughened as the wafer smoothes it. This way the effectiveness of the polishing pad is maintained constant. The function of the slurry is to deliver continuously the mechanical abrasive particles and chemical components to the surface of the wafer and to provide a means of removing reaction products and wafer debris from the polishing surface. There are several varieties of slurry of varying effectiveness and properties known to the art. At present, for the most common type of CMP tool, the rotary polisher, slurry is applied at a constant flow rate onto the rotating polishing pad using a simple delivery tube, nozzle or spray bar. Fresh slurry flows away from the application point(s) under the influence of gravity and centripetal acceleration and becomes mixed with used slurry or slurry that has passed between the polishing pad and wafer and been involved in polishing.

Old slurry besides being chemically "spent" additionally contains the debris from wafer, conditioner and pad which if the old slurry re-enters the gap between the wafer and polishing pad are exposed to the wafer surface and can lead to increases in contamination and defectivity. It is therefore for most purposes important to remove the debris of polishing, and by extension used slurry, from the polishing pad quickly after it is generated and to the greatest extent possible not reintroduce it under the wafer.

Eventually the rotation of the pad brings the slurry into contact with the leading edge of the wafer, where it forms a bow wave. Some of the fresh slurry at this point is advected into the narrow 10 to 25 micron gap between the wafer and polishing pad and is utilized for polishing. The gap exists because the surface of the pad is rough, the surface of the wafer is relatively smooth and the wafer contacts only the high points of the pad surface. However, most of the fresh slurry remains in the bow wave and is carried to the edge of the pad by the combined rotation of the polishing head and pad. The slurry is then lost over the edge of the pad. Thus, actual slurry utilization, the percentage of new slurry applied that enters the gap between the rough pad surface and the wafer of total slurry applied, is universally quite low in such rotary CMP tools. This is a significant problem because slurry consumption and waste disposal account for a large share of the cost of ownership and operation of a CMP tool.

An additional negative influence on polishing removal rate and uniformity arise because when wafers are polished it is the practice in the art to wash used slurry off between wafers by application of deionised water to the pad, typically to the center of the pad. The time between removing one wafer and replacing it with a second is short and invariably a large quantity of water remains on the pad when polishing of the new wafer begins. This water is not uniformly distributed and as a result it dilutes the newly added slurry in a non-uniform way causing both general decrease in removal rate by the diluted slurry and lack of uniformity in removal rate due to variations in slurry concentration on different parts of the pad. Since this effect lasts several seconds it can exert a significant negative effect on anywhere from 25 percent to 50 percent of the time during which the wafer is polished resulting in a significant and costly reduction in process effectiveness and product quality.

To facilitate the advection or entry of the slurry under the wafer, the practitioners of the prior art have used grooves in the CMP pad. This was effective in making sure that some slurry reached the pad-wafer interface but still allowed most of the slurry to be cast off of the pad without ever having been used. Slurry is expensive and devices, equipment and procedures for providing and removing large amounts of slurry must be included in the CMP process which both complicates and encumbers that process. Presently there is no effective method available for substantially reducing the amount of slurry used or making sure that most of the slurry introduced to the pad during CMP is actually introduced between the pad and the wafer and utilized as intended before being cast off of the pad.

Methods to solve this problem to date have, as stated above, consisted of placing grooves in the surface of the CMP pad to conduct some portion of the slurry under the wafer during CMP polishing. In U.S. Pat. No. 5,216,843 (Breivogel et al., hereby incorporated by reference) "an apparatus for polishing a thin film" . . . "said apparatus comprising" . . . "a pad covering said table, said pad having an upper surface into which have been formed a plurality of preformed grooves, said preformed grooves facilitating the polishing process by creating a corresponding plurality of point contacts at the pad/substrate interface." and a "means for providing a plurality of micro channel grooves into said upper surface of said pad while polishing said substrate wherein said microchannel grooves aid in facilitating said polishing process by channelling said slurry between said substrate and said pad." Still in U.S. Pat. No. 7,175,510 (Skyopec et al., hereby incorporated by reference) a method of polishing wherein "The polishing pad has grooves that channels (sic) slurry between the wafer and polishing pad and rids excess material from the wafer, allowing an efficient polishing of the surface of the wafer." is described. Even as recently as Skyopec et al the preferred method for maximizing the amount of slurry that was introduced between the pad and the wafer was preparation of the grooves and the efforts of practitioners of the art were limited to ensuring that these "micro-channels" were regenerated or maintained in a suitable fashion.

In U.S. Patent Application Publication No. 2007/0224920 (hereby incorporated by reference) these grooves are enhanced by holes in the pad made in sizes and shapes appropriate to optimise the amount of slurry conducted under the wafer by the grooves. However this does not solve the basic problem of waste of new slurry due to slurry accumulation in the bow wave.

Moreover, Novellus Systems, Inc. has addressed the slurry utilization problem by means of orbital polishers (U.S. Pat. No. 6,500,055 hereby incorporated by reference) in which the slurry is injected through the polishing pad directly under the wafer (U.S. Pat. No. 5,554,064 hereby incorporated by reference). This guarantees high slurry utilization but requires a complex platen and custom pad to accommodate the slurry distribution system and a specialized polishing tool to take advantage of the injection method. Similarly in U.S. Patent Application Publication No. 2007/0281592 (hereby incorporated by reference) slurries and other conditioning chemicals are introduced and removed through apertures in the diamond conditioning disk for the purpose of facilitating multistep CMP processes but this is not intended to and does not effectively improve the utilization of slurry by directing a larger fraction between the wafer and the CMP pad.

Also in the prior art are U.S. Pat. No. 5,964,413 (hereby incorporated by reference), which teaches an Apparatus for dispensing slurry. This is a device for spraying slurry on to the pad rather than pumping it in specific positions at the pad wafer interface and does not provide the desirable benefits sought by the present invention.

In addition, U.S. Pat. No. 6,929,533, (hereby incorporated by reference) teaches methods for enhancing within-wafer CMP uniformity. This patent describes methods for enhancing the polish rate uniformity of rotary and linear polishers using slurry dispense bars with multiple nozzles to distribute the slurry over the entire wafer track. The slurry dispenser bars sit above the pad and do not contact it. This method lacks the effect of the creation of a layer of slurry with the same thickness as the wafer-pad gap which allows significant amounts of the new slurry to be advected under the pad the first time.

U.S. Pat. No. 6,283,840 (hereby incorporated by reference) teaches a cleaning and slurry distribution system assembly for use in chemical mechanical polishing apparatus. This apparatus has "an outlet to distribute slurry to the enclosed region to form a reservoir of slurry in the enclosed region, wherein the slurry is distributed to a region not enclosed by the retainer by travelling between the polishing surface and the lower surface of the retainer." However, the application of the slurry to specific land areas where it is needed is not taught and in fact most slurry is lost through grooves between the land areas which generally exceed the land areas in cross sectional area between the wafer and the polishing pad. This apparatus also fails to teach or accomplish control over flow as a function of radius from the center of the polishing pad and there is no teaching or reported effect of separation of the old spent slurry, dilution water or polishing wastes from the newly applied slurry. The main function that the apparatus accomplishes is to keep spray from the slurry or from cleaning agents from depositing on the polisher, where the residue can become a source of defect-causing contamination. This is mentioned several times in the description. The background mentions reducing slurry consumption in passing in the last paragraph, but the patent contains no teaching that the apparatus accomplishes this or indeed how it would be accomplished.

U.S. Pat. No. 5,997,392 (hereby incorporated by reference), teaches Slurry injection technique for chemical-mechanical polishing. The slurry application method involves spraying the slurry onto the pad under pressure from a multiplicity of nozzles, however, this invention suffers from the same drawbacks as U.S. Pat. No. 6,929,533 (hereby incorporated by reference) in that lack of precision in the placement and form of the slurry substantially decreases its effectiveness.

U.S. Pat. No. 4,910,155 (hereby incorporated by reference) describes the basic CMP process and utilizes a retaining wall around the polishing pad and polishing table to retain a pool of slurry on the pad. It does not describe a particular method for getting the pooled slurry into the pad wafer gap more effectively. U.S. Pat. No. 5,403,228 (hereby incorporated by reference) discloses a technique for mounting multiple polishing pads onto a platen in a CMP process. A seal of material impervious to the chemical action of the polishing slurry is disposed about the perimeter of the interface between the pads and when the pads are assembled the bead squashes and forms a seal and causes the periphery of the upper pad to curve upward creating a bowl-like reservoir for increasing the residence time of slurry on the face of the pad prior to overflowing the pad.

U.S. Pat. No. 3,342,652 (hereby incorporated by reference) teaches a process for chemically polishing a semiconductor substrate and a slurry solution is applied to the surface of the pad in bursts as a stream forming a liquid layer between the cloth and the wafers to be polished. The solution is applied from a dispensing bottle and is applied tangentially to the wafer-plate assembly so as to provide maximum washing of the polishing cloth in order to remove waste etching products. U.S. Pat. No. 4,549,374 (hereby incorporated by reference) shows the use of a specially formulated abrasive slurry for polishing semiconductor wafers comprising montmorillonite clay in deionised water."

U.S. Pat. No. 6,284,092 (hereby incorporated by reference), teaches a CMP slurry atomization slurry dispense system in which " . . . a polishing slurry dispenser device disposed to dispense the slurry toward the pad preferably as a stream or more preferably drops toward the pad surface and a curtain of air to intersect the slurry at or near the polishing pad surface. The wafer is polished using less slurry than a conventional polishing apparatus while still maintaining the polishing rates and polishing uniformity of the prior art polishing apparatus. A preferred dispenser is an elongated housing having a slurry tube and air tube therein each tube having a plurality of spaced apart slurry openings and air openings along its longitudinal axis which tube is preferably positioned radially over at least one-half the diameter of the polishing pad. A polishing slurry is directed from the slurry tube toward the surface of the pad, preferably in the form of drops, and the air from the air tube forms an air curtain, with the air curtain intersecting the slurry drops preferably at or slightly above the pad surface to atomize the slurry."

While this system distributes the slurry uniformly it does not do so in a way that insures that the thickness of the slurry layer at the leading edge of the wafer is at or close to the thickness of the gap.

U.S. Pat. No. 6,398,627 (hereby incorporated by reference) teaches a slurry dispenser having multiple adjustable nozzles. In the teaching of that art, a "slurry dispensing unit for a chemical mechanical polishing apparatus equipped with multiple slurry dispensing nozzles is disclosed. The slurry dispensing unit is constructed by a dispenser body that has a delivery conduit, a return conduit and a U-shape conduit connected in fluid communication therein between for flowing continuously a slurry solution there through and a plurality of nozzles integrally connected to and in fluid communication with a fluid passageway in the delivery conduit for dispensing a slurry solution. The multiple slurry dispensing nozzles may either have a fixed opening or adjustable openings by utilizing a flow control valve at each nozzle opening. This patent, as with the previous art referred to, possesses no feature that ensures that the thickness of the slurry layer at the leading edge of the wafer is the same as the wafer pad gap.

U.S. Pat. No. 6,429,131 (hereby incorporated by reference) concerns CMP uniformity and teaches improved CMP uniformity achieved by providing improved control of the slurry distribution. Improved slurry distribution is accomplished by, for example, the use of a slurry dispenser that dispenses slurry from a plurality of dispensing points. Providing a squeeze bar between the slurry dispenser and wafer to redistribute the slurry also improves the slurry distribution. This invention can distribute slurry evenly over the pad but does not provide a uniform layer of slurry the thickness of the gap.

However, although the creation and maintenance of grooves and micro-channels are essential for the operation of CMP polishing generally, they still do not afford an efficient means of introduction of slurry between the pad and the wafer whereby most or even a substantial portion of the slurry introduced onto the pad is actually introduced between the pad and the wafer. Furthermore, although a great many methods have been designed for spreading the slurry evenly on the pad none to date have taught a method for preparing a layer of slurry suitably thick for smooth entry into the pad wafer gap. Most of the slurry continues to accumulate in a bow wave of slurry at the leading edge of the wafer which for the most part moves outward along the leading edge to be dumped off of the edge of the pad and wasted. Moreover, used slurry that has been under the wafer and is contaminated returns as the pad is rotated and mixed with the new slurry at the bow wave decreasing significantly the quality of the slurry used in actual CMP and increasing significantly the waste. And finally none of the foregoing methods of the prior art have reduced the negative effects on material removal and uniformity of residual slurry cleaning water added between wafers.

In U.S. patent application Ser. No. 12/262,579 (hereby incorporated by reference) is disclosed a device for injecting slurry between the wafer and the polishing pad in chemical mechanical polishing of semiconductor wafers comprising a solid crescent shaped injector the concave trailing edge of which is fitted to the size and shape of the leading edge of the polishing head with a gap of up to 1 inch, which rests on the pad with a light load, the bottom surface facing the pad, and through which CMP slurry or components thereof are introduced through one or more openings in the top of the injector and travel through a channel or reservoir the length of the device to the bottom where it or they exit multiple openings in the bottom of the injector and are, are spread into a thin film, and are introduced at the gap between the surface of the polishing pad and the wafer along the leading edge of the wafer in quantities small enough that all or most of the slurry is introduced between the wafer and the polishing pad and a method for using the same. In U.S. patent application Ser. No. 12/392,676 (hereby incorporated by reference) is disclosed a method for injecting slurry between the wafer and the pad in chemical mechanical polishing of semiconductor wafers using the apparatus described in U.S. patent application Ser. No. 12/262,579 comprising a solid crescent shaped injector the concave trailing edge of which is fitted to the size and shape of leading edge of the polishing head with a gap of between 0 and 1 inches, the bottom surface facing the pad, which rests on the pad with a light load, and through which CMP slurry or components thereof are introduced through one or more openings in the top of the injector and travel through a channel or reservoir the length of the device to the bottom where it or they exit multiple openings in the bottom of the injector, are spread into a thin film, and are introduced at the junction of the surface of the polishing pad and the wafer along the leading edge of the wafer in quantities small enough that all or most of the slurry is introduced between the wafer and the polishing pad, wherein multiple openings for the introduction of slurry to the device are utilized and fitted with devices that control the flow of slurry of various concentrations of diluent and adjustment is made to these devices during or after polishing to obtain a uniform distribution of new slurry on the land areas of the pad to in turn obtain a more uniform removal rate throughout the wafer.

These most recent applications have largely overcome the problems of the prior art and are more effective than standard center application method of slurry and other prior art slurry addition methods and devices at lower slurry addition rates. However, it is a feature of these two inventions that with their straight leading edges they remove spent slurry more quickly than methods and devices of the prior art. Spent slurry is warmer than newly applied slurry due to accumulated heat generated by the chemical reaction that accompanies polishing of the wafer surface. Thus by quickly removing the spent slurry before it can again come into contact with the wafer, these inventions can lower the temperature on the surface of the wafer. At lower slurry application rates, this effect is largely overcome by the more effective polishing accomplished by a higher percentage of fresh slurry. However, it has been observed that at higher rates of slurry addition, typically around 200 ml per minute, though this varies with CMP tool and the wafer, process and slurry involved, the temperature at the wafer surface can be reduced by as much as 1 to 2 degrees resulting in lower removal rates and therefore longer polishing times to obtain optimal results.

SUMMARY OF THE INVENTION

In embodiments there is presented an invention a slurry injector for use in CMP to which one or more concave depressions or notches have been made into bottom surface of the leading edge of the slurry injector of U.S. patent application Ser. Nos. 12/262,579 and 12/392,676. More particularly, in a certain embodiment, the invention comprises the said slurry injector for use in CMP wherein there are one or more and preferably 5 or more concave smoothly curved inner edges concave impressions or bays or notches, of equal size and evenly spaced along the leading edge of the injector.

In a certain embodiment, there is described a method for injecting slurry between the wafer and the polishing pad in chemical mechanical polishing of semiconductor wafers using the said slurry injector to prevent the depression of the temperature at the wafer surface due to the higher proportion of fresh unreacted slurry provided by the injector.

The embodiment of the invention is more particularly a method for injecting slurry between the wafer and the polishing pad in chemical mechanical polishing of semiconductor wafers using the said slurry injector wherein there are a number of one or more said depressions. Preferably exceeding 5 preferably with concave smoothly curved inner edges, preferably but not necessarily of equal or regularly varying size and preferably but not necessarily evenly spaced along the leading edge of the injector to prevent the depression of the temperature at the wafer surface due to the higher proportion of fresh unreacted slurry provided by the injector.

DETAILED DESCRIPTION OF THE INVENTION

Figure 1:
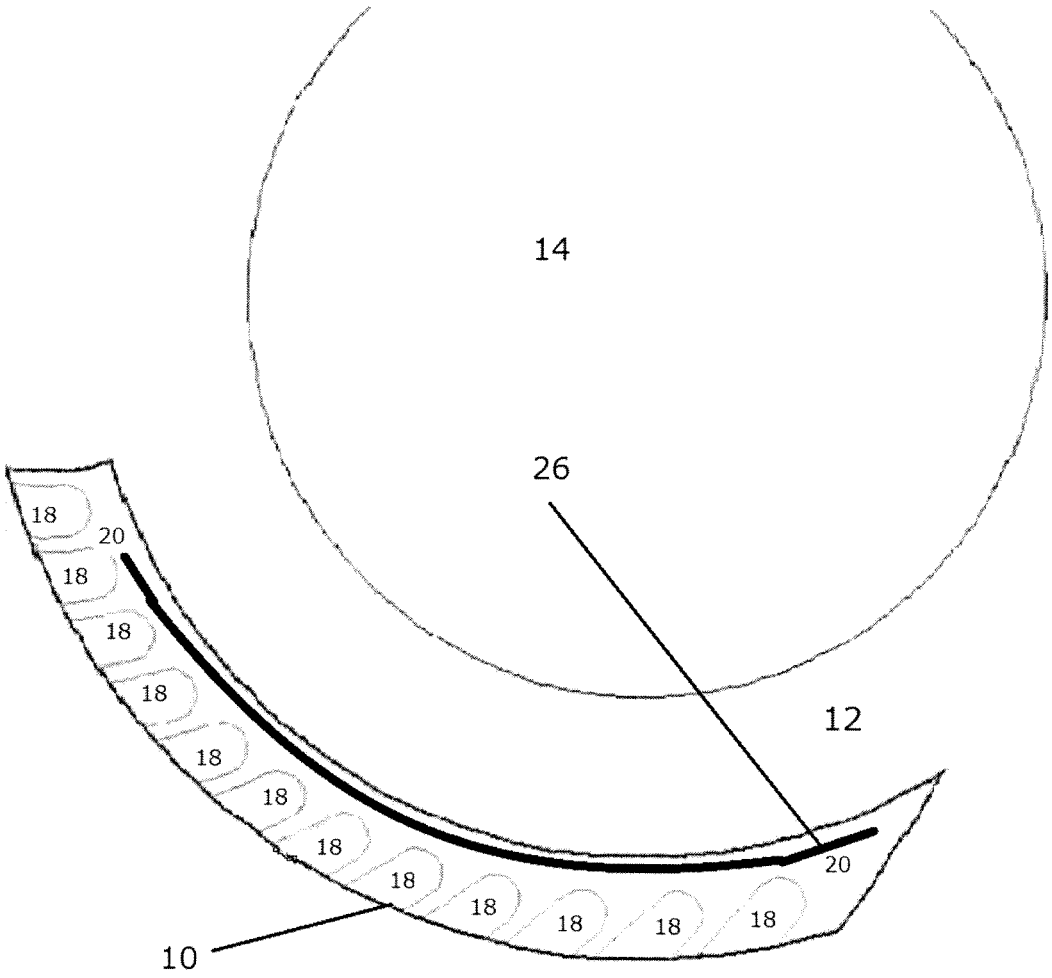
FIG. 1 is a view from below the injector.

In a certain embodiment, there is described a more efficient use of slurry in CMP processes and a more efficient method of introduction of slurry between the pad and the wafer that insures that more new slurry is advected under the wafer and a higher percentage of old used slurry disposed of as waste and that overcomes the deleterious effects of residual wash water on the CMP pad to subsequent slurry concentration and hence removal rates and uniformity while at the same time maintaining a slurry temperature level and thus the removal rate at as high or higher than that of the prior art have after considerable research and effort directed to solving this problem discovered a device and a method for the efficient introduction of slurry between the pad and the wafer that will largely eliminate the waste of slurry, mixing of old and new slurry and residual wash water dilution effects characteristic of the CMP polishing methods of the prior art and allow the operator of rotary CMP polishing equipment considerable control over the introduction of slurry between the wafer and the pad while maintaining a slurry temperature level at the wafer surface approximately the same as or higher than that of the prior art with the consequent more rapid removal rate.

More particularly, the inventor has invented an apparatus for use in chemical mechanical polishing of semiconductor wafers that allows a small amount of higher temperature spent slurry from the bow wave in front of the leading edge of the injector to remain briefly at the leading edge warming the injector, the polishing pad and consequently the fresh slurry injected onto the pad surface by the injector without permitting significant mixture with or contamination of the new slurry by the spent slurry. As the spent slurry accumulates and transfers heat through the injector to the new slurry it is forced from the concave bay, depression or notch by new warmer spent slurry as the pad continuously brings this forth eventually cascading from successive bays, depressions or notches in the direction of the outside of the pad until it is thrown off the polishing pad at the end of the injector. This removal from the pad may be relatively quick or slow depending upon the number, size and geometry of the bays, depressions or notches and other process conditions. By adjusting the geometry, that is to say the size, depth and shape, of the depressions and the number of depressions the heat transfer and temperature maintenance feature can be optimized by one skilled in the art. The inventors have found that semicircular indentations in the leading edge of the bottom of the injector with a diameter about ¼ the thickness of the injector or about one inch appear to be very effective. This apparatus, allows a CMP tool to use a significantly lower overall flow rate by reducing the mixing of fresh and used slurry and the uncontrolled dilution of slurry by wash water prior to use at the wafer, by insuring that the utilization of fresh slurry is closer to 100% and by ejection of only used slurry and wash water from the second bow wave without at the same time being forced to operate at a lower temperature with a lower removal rate for a longer period of time to obtain desired results though for reasons stated this less emphasis may be placed upon this feature of the embodiment of the invention than in injectors of the prior art.

This apparatus more particularly comprises an injector, more particularly the injector of U.S. patent application Ser. Nos. 12/262,579 and 12/392,676, the bottom surface of the leading edge of which has been cut or shaped to possess one or more bays, depressions or notches for the temporary accumulation of a small amount of spent slurry.

Additionally, the inventor has discovered a method in CMP for an applying slurry between the wafer and the polishing pad near the leading edge of the wafer in a thin film that is comparable to the polishing pad wafer gap, thus reducing or eliminating the wafer leading edge bow wave and insuring that a high fraction of fresh slurry is used for polishing the wafer, and that creates a second bow wave at the leading edge of the injector, which second bow wave is physically separated from the wafer leading edge by the injector, and which second bow wave is further partially captured in the said bays, depressions or notches so that, for a short time it is partially prevented from being thrown from the polishing pad and thus may transfer heat through the injector or the polishing pad to the cooler new slurry being injected under the wafer.

In an embodiment, the apparatus has been developed in response to the present state of the art, and in particular, in response to the problems and needs in the art that have not yet been fully solved by currently available CMP slurry supply systems for CMP tools. Thus, it is an overall objective of the present embodiment to provide CMP slurry injectors and related methods that remedy the shortcomings of the prior art.

The purpose of this device and method are to allow more effective injection of slurry into the space between the polishing pad and the wafer and to prevent new slurry being excessively contaminated by old slurry that has remained on the pad after use under the wafer and by residual water used to clean the polishing pad between wafers while at the same time maintaining the temperature obtained from the reaction of the spent slurry during the polishing of the wafer and imparting it to the newly injected slurry, thus maintaining a higher removal rate and a reduced operation time in addition to the substantial reduction of slurry required.

CMP slurry should be new (pre-diluted) slurry so that it is more able to wear away and planarize the metal surface of wafers for such semiconductor wafers as silicon wafers or silicon compound wafers that have been plated with copper or tungsten or other materials and thereafter to planarize the semiconductor surface itself. When old slurry or water are allowed to mix with new slurry in large and uncontrolled amounts and much of this mixture is allowed to be disposed of from the polishing pad without ever having been used under the wafer, there is substantial waste of slurry and the slurry that does eventually find its way under the wafer is not entirely effective. However, without this mixing, the cooler temperature of the new slurry results in a lower reaction rate. The unique and original design of the new embodiment of the invention preserves the benefits to the CMP process and the reduction of slurry use of maintaining the separation of new and spent slurry while at the same time obtaining the benefits of the higher temperature of the spent slurry on reaction rates and to some extent the allowance of a certain amount of old slurry to be incorporated in the slurry used at the wafer where that is desirable for chemical reasons in maintaining a higher reaction temperature.

Manufacturers and users of CMP pads need to minimize slurry waste, maintain suitable reaction temperatures at the wafer surface and maximize slurry efficiency and consistency in quality of the slurry applied to obtain the most cost effective and high quality polishing of wafers.

The problem of waste and the resultant inconsistent and often poor quality of the slurry that ends up under the wafer has been known in the art for some time and was largely solved by the inventions of U.S. patent application Ser. Nos. 12/262,579 and 12/392,676. The practiced invention however was observed to raise the problems of decrease of the temperature at the wafer surface due to the loss of the heat of reaction carried by the spent slurry and its consequent reduction of removal rate that at higher slurry addition rates used in some CMP polishing became a significant effect.

In a certain embodiment, the problems of the prior art are overcome by obtaining the transfer of heat from spent slurry to new slurry and effectively raising the temperature of the new slurry to close to the temperature of the spent slurry while at the same time adjusting to a more greatly controlled and optimal extent the physical separation of used slurry and residual water from newly added slurry on the polishing pad surface and by insuring that as much as possible of the new slurry ends up in the gap between the wafer and the polishing pad and not in a bow wave before the leading edge of the wafer where much if not most of the new slurry would be sloughed off of the edge of the polishing pad by outward centripetal forces generated by the rotation of the pad without ever having been used.

Through the use of the slurry injector of the embodiment, consistent, effective and reduced volume usage of slurry use can be achieved easily with improved polished wafer quality and without decrease in removal rate or an increase in operation time.

All dimensions for parts in a certain embodiment are based on a pad size of about 20" to 30" in diameter and a wafer size of between 8" and 12" in diameter and may be altered as needed in proportion to changes in the size of the polishing pad and wafer used. The specific dimensions given herein are in no way limiting but are by way of example to demonstrate an effective embodiment of the invention.

A certain embodiment comprises a device and a method for the efficient introduction of slurry between the polishing pad and the wafer that while largely eliminating the waste of slurry characteristic of the CMP polishing methods of the prior art, allowing the use of a purer unused and undiluted slurry at the polishing pad surface at all times and allowing the operator of CMP polishing equipment considerable control over the introduction of slurry between the wafer and the polishing pad will additionally continue to take advantage of the accumulated reaction heat in the spent slurry to maintain a higher temperature on the wafer surface during polishing. More particularly, beginning with FIG. 1, a certain embodiment of the invention comprises a device for injecting slurry between the wafer and the polishing pad in the chemical mechanical polishing of semiconductor wafers, such as those disclosed in U.S. patent application Ser. Nos. 12/262,579 and 12/392,676 wherein the bottom surface of the leading edge 10 of the injector which rests on the polishing pad 12 possesses one or more bays, depressions or notches.

As the polishing tool, utilized in certain embodiments of the invention, any suitable rotary polishing tool may be used. In particular existing rotary polishing tools may be retrofitted with the apparatus of certain embodiments of the invention. Any polishing pad 12 suitable for use in CMP may be used. Moreover, any diamond conditioner disk (not shown) suitable for use in CMP may be used.

For the slurry, any applicable CMP slurry may be used and for example, silica based and alumina based slurries may either or both be used.

In certain embodiments, the injector may be any CMP slurry injector or combination of injectors that injects slurry in front of the wafer 14 in a narrow pad and acts to separate the spent slurry in the bow wave preceding the injector from the said new injected slurry, provided, however, that the injectors described in U.S. patent application Ser. Nos. 12/262,579 and 12/392,676 are preferred. One or more bays, depressions or notches 18 are added to the leading edge 10 of the bottom surface of the injector. Where layers are used, the said bays, depressions or notches 18 may be cut, shaped or molded only through all or part of the said bottom layer 22 or may be made all the way through the said bottom layer 22 and one or more of the overlying layers 24.

The number of the said bays, depressions or notches 18 is not particularly limited and any suitable number may be used however five or more bays notches or depressions is preferred and ten or more bays, depressions or notches is more preferred.

The size of the said bays, depressions or notches 18 is not particularly limited, however the said bays, depressions or notches 18 should not be so large that they accumulate more spent slurry than can be easily forced out by additional incoming spent slurry in the normal operation of CMP nor so small that they do not provide sufficient retention of spent slurry to effect suitable transfer of the heat held in the spent slurry to the injector and thence to the new slurry and the wafer surface. A bay, depression or notch 18 width or diameter of between 5 percent and 75 percent of the average width of the injector is preferred and a width or general diameter of 10 to 40 percent of the average width of the injector is more preferred. The bays, depressions or notches 18 may also be in the form of a channel with parallel walls and a semicircular end opening to the leading edge of the injector. The channel may be up to 2 times as long as it is wide and its length may be up to 70% of the average width of the injector. In any case, care should be taken to avoid making the contact distance between the bay, depression or notch 18 and the slurry inlet or inlets too small.

The material of the injector between the bays, depressions and notches 18 and the slurry inlet structures of the injector 26 is not particularly limited and the materials otherwise used to manufacture injectors of this type may be used, provided however, that materials that enhance thermal conduction may be used as the material of the injector or incorporated in such a way as to enhance the thermal conduction of certain embodiments of the invention. Particularly, small sheets, wires, nets, meshes or heat conducting filler or even tubular convection networks for heat convecting fluids may be incorporated into the material used to make the injector body.

The shape of the bays, depressions or notches 18 of certain embodiments of the invention is not particularly limited and any shape that is capable both of holding a suitable volume of spent slurry and allowing it to flow outward smoothly when forced out by incoming spent slurry from the polishing pad may be used. Smoothly curved concave shapes are preferred and circular bays that are tapered in the direction allowing easy flow of the spent slurry outward toward the edge of the pad are more preferred.

The orientation of the bays depressions or notches 18 is not particularly limited and any suitable orientation may be used. However, orientations parallel along their longer axis, where applicable, to the motion of the polishing pad at the point of contact with the leading edge of the injector are preferred.

The uniformity in size of the bays, depressions or notches of certain embodiments of the invention are not particularly limited and they may be of identical or different sizes. However, gradual and consistent variation in size is preferred where variation is practiced and equal size is preferred.

The uniformity in shape of the bays, depressions or notches of certain embodiments of the invention are not particularly limited and they may be of identical or different shapes. However, gradual and consistent variation in shape is preferred where variation is practiced and identical shapes are preferred.

The uniformity of the orientation of the bays, depressions or notches 18 of certain embodiments of the invention are not particularly limited. However, uniform orientation either parallel to each other (where applicable) or uniform with respect to the leading edge of the injector are preferred.

The general shape of the injector is not particularly limited and may take the shape of prior art crescent injectors or either the leading edge, the trailing edge or both may be straight or may possess any other geometry not contrary to the purposes of the embodiments of the invention particularly so that one skilled in the art may easily apply the present injector to any of a wide variety of currently used CMP polishing tools.

The gap between the trailing edge is not particularly limited and may be but is not limited to the gap described in the prior art and may be significantly larger or smaller at the discretion of one skilled in the art depending upon particularly the dynamics of slurry fluid flow, the temperature requirements of the CMP process being used or the requirements of the particular CMP tool being used and particularly gaps of varying width and gaps of larger than one inch may also be used.

Although the slits or holes in the bottom of the injector of the prior art may be used, alternate methods of slurry introduction may also be used in certain embodiments of the invention exclusively or in conjunction with methods of prior art injectors incorporated into certain embodiments of the invention provided that the slurry temperature modification features of the embodiments remain feasible in conjunction therewith.

An additional embodiment comprises the injector in which the slurry inlet tube, channel or chamber and holes or slits in the bottom of the injector have not been prepared or attached and which comprises merely the layer or layers of material into the leading edge of the bottom of which the bays, depressions or notches have been equipped, the slurry being added independently from this structure by prior art means such as the standard center application method or other suitable means.

EXAMPLES

A Do w Electronic Materials IC-10-A2 CMP pad was attached to an Araca Incorporated APD-800X 300-mm CMP polishing tool and a 3M A2810 conditioning disk was attached as well. A stainless steel shaft approximately 6.5 inches in length and 0.3125 inch in diameter was slipped into a hole in an adjustable beam clamped to the support mechanism of the CMP tool. A spring was placed between the collar and the support mechanism along the rod, the spring was compressed, and the collar was attached with a set screw to the rod. This had the effect of transferring the force from the spring to the surface of the pad via the injector. A separate set screw for the rod in the adjustable beam was then used to attach the rod to the support mechanism to fix the load and to prevent the rod from turning about its own axis.

The injector was fabricated with two sheets (i.e. top and bottom) of clear polycarbonate (GE Plastics XL10, 0.17 inch thickness) cut together using a band saw to produce two identical shapes as shown in FIG. 1. Note that the length of the slurry outlet slit in FIG. 1 does not correspond to the device used in these practice examples but to a more generic embodiment. The shapes approximately 10 inches from end to end and with a trailing edge length corresponding to a polishing head of diameter of 11.125 inches and a width of 1 inch. A hole ½ inch in diameter was drilled half way through the top sheet to accept the gimbal mechanism. In the bottom sheet a 1 inch length channel (not shown to scale in FIG. 1) was cut within ¼ inch of the horn or end of the injector located nearer to the pad center and about ¼ inch from the trailing edge. The channel was ⅛ inch in width. Finally an inlet hole of ⅜ inch diameter was drilled in the top sheet and fitted with an inlet tube, a 4 inch section of Tygon tubing, and a quick connector suitable for attachment to the Tygon tubing used with the polisher.

Into the bottom sheet were cut 12 bays the central lengthwise axis of which was 1.5 inches in length and ⅞ of an inch wide. These were separated by spaces of about ¼ inch and the long axis was parallel to the direction of slurry flow at the leading edge. The end was cut in a semicircle ⅞ inches in diameter. The said 1.5 inch length included the 7/16 inch half diameter of the semicircle. Because of the change in orientation of the leading edge of the injector to the direction of the motion of the polishing pad at the point of contact with the leading edge over the length of the leading edge of the injector, the length of the lengthwise axis of the said bays is progressively longer from the center of the polishing pad where the axis length is 1.1 inches to the outer edge of the pad where the axis length is 1.5 inches.

The sheets were affixed together using double sided adhesive cloth so that the edges were even. A gimbal mechanism allowing free adjustment of bank and pitch but not rotation about the axis of the rod was placed in the half inch hole on the top of the injector, secured with a metal pin, and attached to the rod.

Practice Examples 1-6

Figure 3:
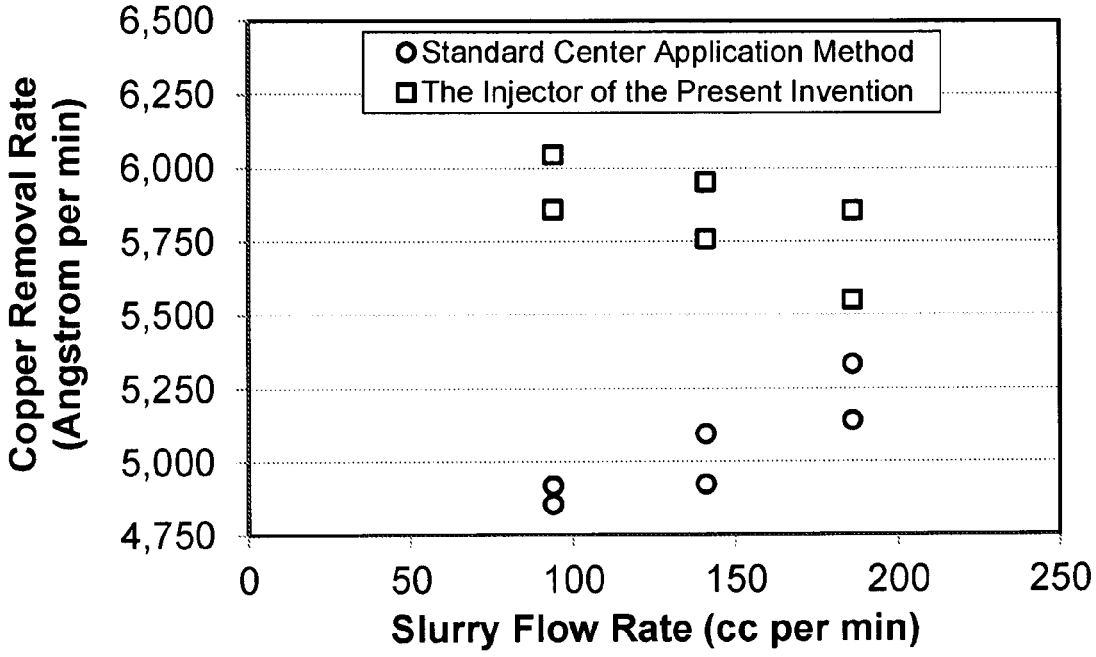

After successful preliminary tests of the integrity and stability of the injector using water flow rates of 94, 141 and 186 ml/min, 2 polishing tests for each flow rate were run as follows. A new Rohm and Haas IC-10-A2 pad was conditioned for 45 minutes with a new 3M A2810 grit conditioning disk on an Araca Incorporated APD-800 polisher using the "best known method" conditioning sweep, which was designed to optimize the flatness of the pad surface over the lifetime of the pad. Three hundred millimeter diameter blanket copper wafers were then polished at 1.9 PSI for 1 minute with in situ conditioning (conditioning while polishing) using a silica based slurry with hydrogen peroxide as oxidizer with a platen rotation rate of 80 RPM and a carrier rotation rate of 88 RPM. After each wafer was polished, used slurry was rinsed from the pad by applying 2-3 liters of deionized water from a beaker. Prior to running wafers to be used for measuring removal rates ("rate wafers"), a used ("dummy") TEOS wafer was processed for several minutes and then a series of 11 TEOS dummies were polished for one minute each until the mean coefficient of friction (COF) stabilized. After each change in flow rate, a TEOS dummy was run for 1 minute to stabilize the system prior to running rate wafers. Mean removal rates measured using a reflectometer from two diameter scans of each of the two rate wafers processed at each flow rate are shown in FIG. 3.

Comparative Experiments 1-6

Except that an injector was not used and slurry was added by standard center application method, the same polishing tests were run as described in Practice Examples 1-6.

Practice Examples 7-9

Figure 4:
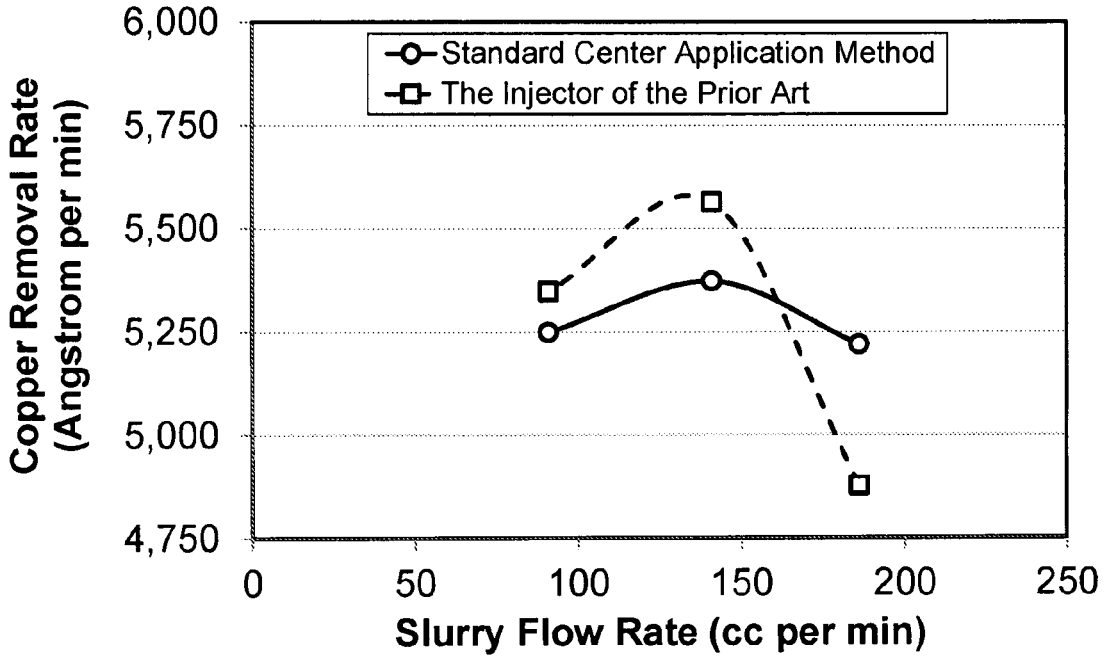

And the results for removal rate for the prior art injector versus standard slurry application method are shown in FIG. 4.

Comparative Experiments 7-9

Except that an injector was not used and slurry was added by standard center application method, the same polishing tests were run as described in Practice Examples 7-9. The results were shown in FIG. 4.

Figure 5:
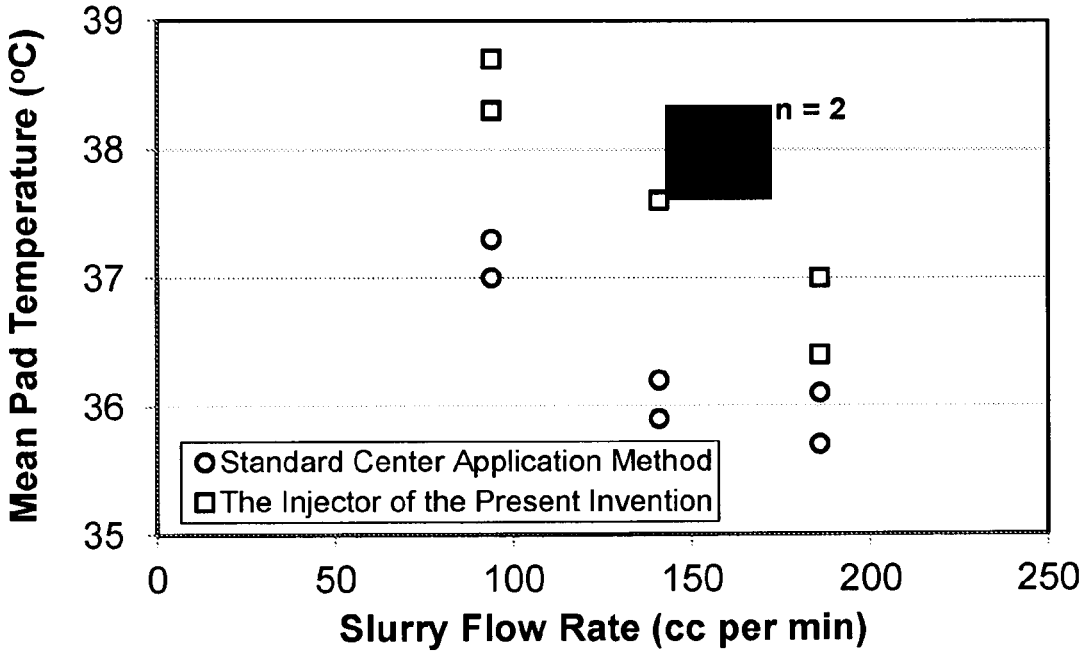

Moreover, mean pad temperatures were measured during each of the tests for the injector of the embodiments and standard center application method tests and the results were shown in FIG. 5.

Figure 6:
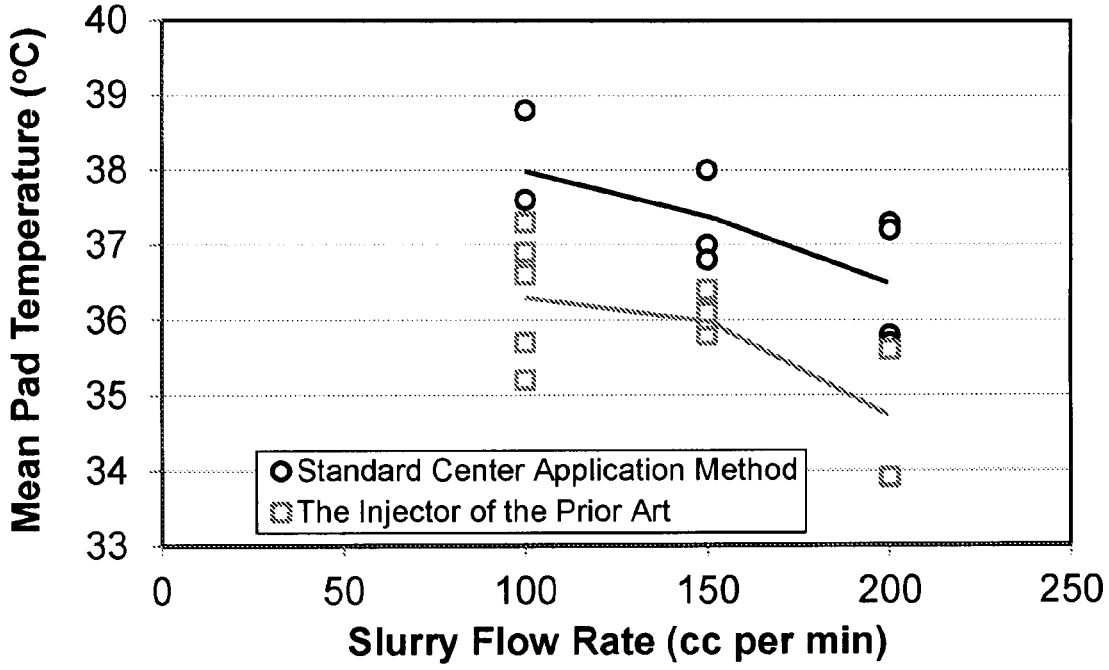

And the results for mean pad temperatures for the prior art injector versus standard center application method are shown in FIG. 6.

Mean Pad Temperature was measured by IR non contact measurement device at the midpoint of the wafer track.

DETAILED DESCRIPTIONS OF THE DRAWINGS

FIG. 1 is a bottom view of the slurry injector and the wafer, wherein 10 is the bottom surface of the leading face of the injector.

Figure 2:
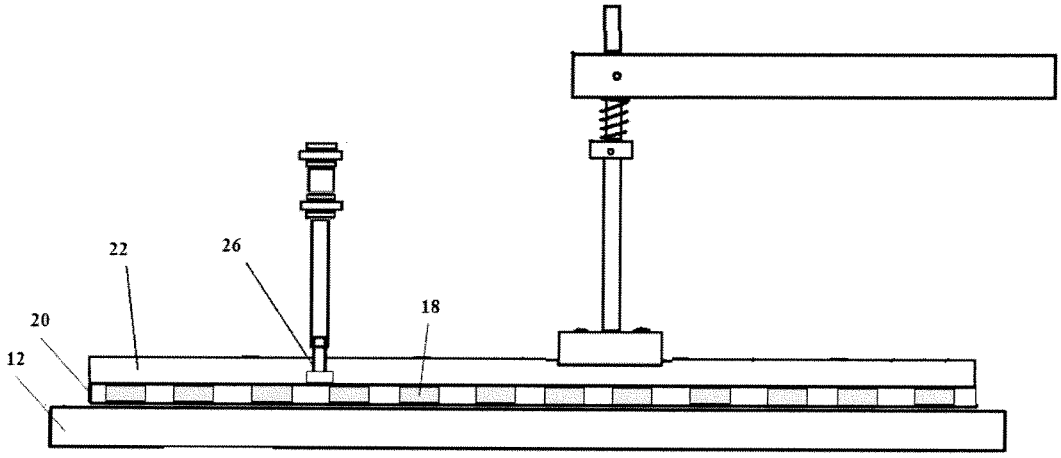
FIG. 2 is a cross section side view of the injector over the pad.

FIG. 2 is the cross sectional side view of the injector of a certain embodiment of the invention, wherein 12 is the polishing pad, 14 is the wafer, 18 is the bays notches or depressions, 20 is the bottom layer of the injector, 22 is the upper layers of the injector, 26 is the slurry inlet structures of the injector.

FIG. 3 is a graph of copper removal rate versus slurry flow rate.

FIG. 4 is a further graph of copper removal rate versus slurry flow rate.

FIG. 5 is a graph of mean pad temperature versus slurry flow rate.

FIG. 6 is a further graph of mean pad temperature versus slurry flow rate.

EFFECTS OF CERTAIN EMBODIMENTS OF THE INVENTION

The certain embodiment, by causing reacted spent slurry to accumulate in the bays, depressions or notches on the bottom surface of the leading edge of the slurry injector of the embodiment allows the heat of the spent slurry to be transferred to the pad and through the injector to the new unspent un-reacted slurry. This transferred heat causes the temperature of the polishing pad under the wafer to be slightly higher than would be the case with a standard injector lacking the features of the embodiment of the invention.

The resulting increase in temperature not only improves the removal rate and thereby decreases the time and slurry consumption for a particular CMP process, it does so while preserving the existing salutary features of slurry injection technology which are to reduce the contamination and thereby the decline in effectiveness of new slurry and to reduce waste of slurry that is thrown from the pad in a bow wave before use.

There is also the possibility that the slight increase in spent slurry that finds its way under the injector may in cases such as that of copper ion derived from copper plating removed by CMP that catalyzes the further chemical action against the copper sheet again increasing the removal rate in that specific kind of CMP.

The potential benefits in cost savings resulting from savings in slurry and time due to the improvements of the embodiments of the invention over the prior art are both substantial and easily and conveniently obtained by use of the embodiments of the invention.

What is claimed is:

1. A device for injecting slurry between a wafer and a pad in chemical mechanical polishing of semiconductor wafers comprising an injector, the bottom surface of the leading edge of which possesses one or more bays, depressions or notches wherein the one or more bays, depressions, or notches are separated from a slurry inlet structure by a contact distance.

2. A device for injecting slurry according to claim 1 wherein number of bays, depressions or notches is five or more.

3. A device for injecting slurry according to claim 2 wherein the number of bays depressions or notches is 10 or more.

4. A device for injecting slurry according to claim 1 wherein the bays, depressions or notches are all the same shape.

5. A device for injecting slurry according to claim 1 wherein the bays, depressions or notches are all the same size.

6. A device for injecting slurry according to claim 1 wherein the bays, depressions or notches are all progressively larger along the leading edge.

7. A device for injecting slurry according to claim 1 wherein the shape of the bays, depressions or notches is a channel with perpendicular walls ending in a semicircle.

8. A device for injecting slurry according to claim 7 wherein the orientation of the lengthwise axis of the bays, depressions or notches is parallel to the direction of motion of the polishing pad at the point of contact with the leading edge of the injector traversed by the said axis.

9. A method for injecting slurry between a wafer and a pad in chemical mechanical polishing of semiconductor wafers using an injector wherein the bottom surface of the leading edge of which possesses one or more bays, depressions or notches wherein the one or more bays, depressions, or notches are separated from a slurry inlet structure by a contact distance.

10. A method for injecting slurry according to claim 9 wherein number of bays, depressions or notches of the injector is five or more.

11. A method for injecting slurry according to claim 10 wherein the number of bays depressions or notches of the injector is 10 or more.

12. A method for injecting slurry according to claim 9 wherein the bays, depressions or notches of the injector are all the same shape.

13. A method for injecting slurry according to claim 9 wherein the bays, depressions or notches of the injector are all the same size.

14. A method for injecting slurry according to claim 9 wherein the bays, depressions or notches of the injector are all progressively larger along the leading edge.

15. A method for injecting slurry according to claim 9 wherein the shape of the bays, depressions or notches of the injector is a channel with perpendicular walls ending in a semicircle.

16. A method for injecting slurry according to claim 15 wherein the orientation of the lengthwise axis of the bays, depressions or notches of the injector is parallel to the direction of motion of the polishing pad at the point of contact with the leading edge of the injector traversed by the said axis.

17. A device for injecting slurry according to claim 1 wherein the injection is not done through slurry inlets, channels or chambers or slits or holes in the bottom surface of the device.

18. A method for injecting slurry according to claim 9 wherein the injection is not done through slurry inlets, channels or chambers or slits or holes in the bottom surface of the device.

* * * * *